US005520746A

United States Patent [19]

Kamiya

[11] Patent Number: 5,520,746

[45] Date of Patent: May 28, 1996

[54] DETERGENT FOR CLEANING DRAIN PIPE

[75] Inventor: Akira Kamiya, Kanagawa-ken, Japan

[73] Assignee: Kabushiki Kaisha Sunyda, Tokyo, Japan

[21] Appl. No.: 353,564

[22] Filed: Dec. 9, 1994

Related U.S. Application Data

[63] Continuation of Ser. No. 5,018, Jan. 15, 1993, Pat. No. 5,407,595.

[51] Int. Cl.[6] ..... B08B 9/04; B08B 9/02

[52] U.S. Cl. ..... 134/22.11; 252/174.12; 252/DIG. 12; 252/142; 252/174.14

[58] Field of Search ..... 252/174.12, DIG. 12, 252/142, 174.14; 134/22.11

[56] References Cited

U.S. PATENT DOCUMENTS

| | | | |
|---|---|---|---|
| 3,506,582 | 4/1970 | Gertzman et al. | 252/157 |
| 3,707,505 | 12/1972 | Maeda et al. | 252/136 |
| 4,540,506 | 9/1985 | Jacobson et al. | 252/174.12 |
| 4,610,800 | 9/1986 | Durham et al. | 252/174.12 |
| 5,264,146 | 11/1993 | Tobiason | 252/157 |
| 5,407,595 | 11/1993 | Kamiya | 252/174.12 |

FOREIGN PATENT DOCUMENTS

| | | |
|---|---|---|
| 0178931 | 4/1986 | European Pat. Off. . |
| 61-133296 | 6/1986 | Japan . |

*Primary Examiner*—Paul Lieberman
*Assistant Examiner*—Kery Fries
*Attorney, Agent, or Firm*—Tarolli, Sundheim, Covell, Tummino & Szabo

[57] ABSTRACT

A detergent for cleaning drain pipe comprises lipocatabolic lipase and an imbibing agent. Sodium hydrogencarbonate may be used as an imbibing agent. The detergent may includes a foaming agent, pH conditioning agent, and/or enzyme activation retaining agent. Tartaric acid may be used as a foaming agent. Sodium carbonate may be used as a pH conditioning agent. N-acylic amino acid may be used as an enzyme activation retaining agent.

10 Claims, 1 Drawing Sheet

DETERGENT FOR CLEANING DRAIN PIPE

CROSS-REFERENCE TO RELATED APPLICATION

This application is a continuation of Ser. No. 08/005,018 filed Jan. 15, 1993 now U.S. Pat. No. 5,407,595 issued Apr. 18, 1995 which is entirely incorporated herein by reference.

BACKGROUND OF THE INVENTION

1. Field of the Invention

This invention relates to a detergent or a cleaning agent useful in removing slime adhered to inner wall of a drain pipe, as well as in preventing blockage of such drain pipe.

2. Description of Prior Art

Drainage or waste water flowing through a drain piping, such as kitchen waste piping in a high-rise or middle rise condominium or commercial building, includes a large quantity of fatty material. An adult usually waste approximately 2 grams (lard-equivalent value) of fatty material a day. Such fatty material possesses a high viscosity and is easily adhered to the inner wall of a piping since it is usually solidified at ordinary temperature. Growth of deposition of fats, proteins, hydrocarbons, and organic and inorganic impurities on such solid fatty material may reduce effective area of a piping, thus causing insufficient flow characteristics of a piping. It is noted that such a detergent has not been provided heretofore that may be daily used to prevent blockage of a piping when flown into a piping.

During cleaning operation of a drain piping, it very important to remove solid, fatty material from the inner wall of a piping in order to avoid subsequent blockage of a piping. Prior art detergent, consisting of hydrochloric acid, sulfuric acid, or sodium hydroxide, however, was incapable of removing slime deposited in an area where detergent solution is not directly applied. It is also noted that hydrochloric acid or sulfuric acid is very dangerous during handling thereof, and they tend to cause water pollution problem when flown into a sewerage or into a river, together with dissolved slime.

SUMMARY OF THE INVENTION

It is an object of the invention to provide a safe and harmless detergent which is capable of decomposing fatty material adhered to tableware, preventing solidification of fatty material in a drain piping, and preventing fatty material from adhering to the inner wall of a piping.

It is another object to provide a detergent for use in cleaning a drain pipe which may quickly remove slime in such a drain pipe.

A detergent for cleaning a drain pipe and preventing blockage thereof according to the invention comprises lipocatabolic lipase and an imbibing agent. The detergent of the invention may be in powder or solution dissolved in water. The detergent of the invention may be used as a cleaning agent for pipe cleaning operation, as well as a detergent for tableware. Thus, the detergent of the invention may be applied directly to a drain piping or may be used for the purpose of washing tableware. When the detergent is used in order to wash tableware, such detergent washed away from the tableware will adhere to the inner wall of a piping so as to prevent dirty material from adhering to the inner wall of a piping.

Lipocatabolic lipase is known to those skilled in the art and is commercially available. When the detergent of the invention is used as a pipe cleaning agent, lipase is selected to have a lipocatabolic ability or decomposing effect of 10–100 u per 1 gram (dry basis) of material adhered to a piping. When the detergent is used as a tableware cleaning agent. Lipase is selected to have a lipocatabolic ability of 20–60 u per 1 gram of fatty material (lard-equivalent value). It is noted here that ability of 1 u represent an ability of lipase capable of liberating a 1 micro-mol of fatty acid from olive oil at 20 degree Celsius. Amount of lipase to be added may be changed depending upon a temperature at which it is used, since lipocatabolic ability thereof will vary with given temperature. The amount of lipase to be added is also changed depending upon degree of dirtiness, diameter of a drain pipe, quantity of water remaining in a piping, degree of blockage. It is noted however that, in general, detergent of the invention containing less than 1 wt-% of lipase will not work satisfactorily.

Imbibing agents to be used in the invention may include, for example, sodium hydrogencarbonate, magnesium carbonate, calcium carbonate, ammonium hydrogencarbonate, ammonium carbonate, etc. These imbibing agents may be used individually or may be used in combination of two or more agents. Sodium hydrogencarbonate is specifically preferred to be used as an imbibing agent. Lipocatabolicity of lipase is extremely increased under presence of sodium hydrogencarbonate (refer to Examples 1 and 2). This is because that sodium hydrogencarbonate disperses fats adhered to tableware or drain pipes into fine flocks or granules so as to be imbibed, to thereby increasing surface area of such fats. Lipase infiltrates into such imbibed fats, while sodium hydrogencarbonate serves as a catalyst to emphasizing the lipocatabolic action of lipase, so that lipocatabolicity is greatly increased. Preferably, sodium hydrogencarbonate is added in the amount of 50 wt-% or more of the detergent of the invention.

The detergent of the invention may include a foaming agent in addition to lipase and sodium hydrogencarbonate. Such foaming agent reacts with water or alkaline sodium hydrogencarbonate to generate enormous amount of foams or bubbles. Thus, fatty material adhered to tableware or drain pipe wall is greatly imbibed due to the foaming ability, so as to increase surface area thereof, whereby lipocatabolicity of lipase is facilitated. It is noted, further, that, due to the strong foaming ability of the foaming agent, the detergent of the invention will be splashed to an area where the detergent of the invention has not been directly applied, whereby washing ability is increased and area to be washed is extended. Accordingly, it is specifically advantageous to use the detergent of the invention containing foaming agent with respect to extremely dirty field. Foaming agents may include, for example, tartaric acid, potassium hydrogen tartrate, citric acid, succinic acid, malic acid, uric acid, fumaric acid, sodium fumaric acid, etc. These foaming agents may be used singly or in combination of two or more such agents.

Aqueous solution containing the detergent of the invention is preferably maintained at an pit value between 7 to 10. A pH value between 7 to 9 is more preferable. The detergent will be harmless and handled safety when a solution containing the same is maintained at weak basic region. Thus, the detergent is less stimulative to human skin and does not give adverse effect to the circumstance when flown into a river or drainage, thus causing no pollution problem. In order to maintain suitable pH value, the detergent of the invention may include a pH conditioning agent. Such pH conditioning agents may include, for example, sodium carbonate, sodium silicate, sodium sulfate, etc. These conditioning agents may be used singly or in combination of two or more agent. It is particularly preferred to use a pH conditioning agent for pH adjustment when acidic foaming agent is used.

The detergent of the invention may further include enzyme activation retaining agent. Enzyme activation retaining agent is intended to have function or ability to increase reservability of lipocatabolic lipase and persistability of activated enzyme after dissolved. Enzyme activation retaining agents may include, for example, N-acylic amino acid. N-acylic amino acid will function not only as an enzyme activation retaining agent but also as a surface active agent. Accordingly, the detergent may have suitable washing ability depending upon degree of dirtiness concerned, when additive amount of N-acylic amino acid is controlled.

The detergent of the invention may include enzyme other than lipase. For example, prosthesis and amylase may be used singly or in combination thereof. Inclusion of these enzymes makes it possible for the detergent of the invention to have ability of decomposing proteins and hydrocarbons contained in dirty material.

When the detergent is used to wash or clean a drain piping, the detergent may be applied through an opening of a drain piping, or may be applied centrally into a particular drain piping. The detergent of the invention to be used in the above case, it may be in powder form or in aqueous solution.

When the detergent is centrally applied into a particular piping, a length of wire braided hose having a nozzle at the tip thereof, for example, is introduced in the piping to an application point. Then, aqueous solution containing the detergent is ejected from the nozzle at a pressure less than 150 kg per square centimeter. By this, slime deposited in the central region of the piping is broken into pieces by means of impact energy of the aqueous solution containing the detergent. The broken pieces are blown to all directions by means of the aqueous solution striking on the wall of the piping to be splashed, whereby the pieces are admixed instantaneously. Thus, substantially the whole surface of the pieces is covered with the detergent solution, so that solid fatty material is decomposed and dissolved in water by means of lipase. After the slime in the central region of the piping has been removed, aqueous solution containing the detergent is splashed to and adheres to the surface of the slime layer deposited on the wall of the piping in a film-like configuration. The slime is decomposed in similar manner, so that the inner wall of the drain piping will be cleaned. The washing or cleaning process will be proceeded in the above manner. It is noted therefore that injection pressure of the aqueous solution containing the detergent discharged from the nozzle is selected to be a value sufficient to break the slime and mix the same. Thus, an excessive high pressure will not be required, which might cause the slime layer in a film state to be striped off. It is noted further that, even though the injection nozzle is not properly located within the piping, slime deposited on the wall of the piping will be completely and uniformly removed, since the aqueous solution containing the detergent is splashed in the piping so as to adhere to the entire inner surface of the piping.

It is preferable to introduce a length of hose braided with guide wire into a piping having a plurality of bends on pressure of the detergent solution may be kept at a value less than 150 kg per square centimeter, so that cleaning process can be proceeded, without impairing fittings in the piping. In a complicated piping in particular, the detergent solution, when ejected, is splashed inside the piping in a mist or flog manner so as to adhere substantially the whole inner surface of the piping for decomposing solid fatty material. Thus, inner wall of a piping which has been difficult to be cleaned in prior art technique may be securely cleaned.

When a piping with high degree of blockage is to be cleaned, it is preferable to use detergent solution containing a foaming agent. As stated above, foaming agent, with foam generating ability, serves to stir and disperse solid fatty material in slime, so that effective area upon which lipase can be acted to decompose such fatty material will be increased. Thus, decomposing ability of the detergent is greatly increased. As will be appreciated, the detergent solution, even in a small amount, produces high cleaning ability, so that it may effectively clean a piping with high degree of blockage. On the contrary, and when a large amount of detergent solution is injected so as to remove slime in the piping, excessive amount of slime will be removed from the piping which might cause blockage of remaining portion of the piping or branch piping. The use of the detergent solution having high cleaning ability prevents such problem. The detergent solution may be applied prior to introduction of wire into the piping, simultaneously with insertion of wire to break slime, or after introduction on the wire into the piping.

It should be noted that the detergent composition according to the invention not only involves washing or cleaning ability, but also serves to facilitate metabolism. Thus, it is expected For the detergent to be used as a bathing amusement agent if it is conditioned to have reduced stimulative characteristics to human skin. It is also expected for the detergent composition of the invention to be used as a beverage, since it promotes digestion of human body.

BRIEF DESCRIPTION OF THE DRAWINGS

For a better understanding of the invention, and to show how the same may be carried into effect, reference will now be made, by way of example, to the accompanying drawings in which like reference numerals refer to like elements.

DETAILED DESCRIPTION OF THE PREFERRED EMBODIMENTS

Figure 1:
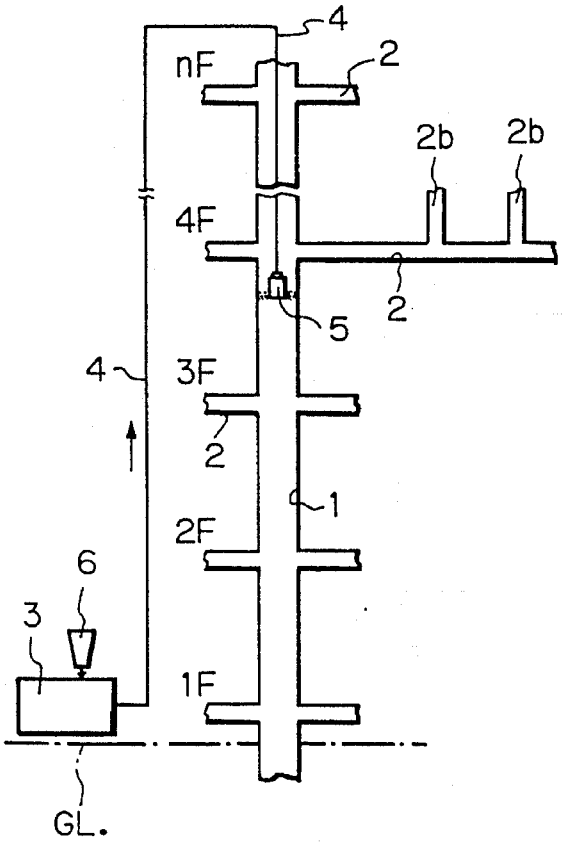
FIG. 1 is an illustrative view showing a method for washing drain pipe in a high-rise building by the use of detergent of the invention.

The invention will be explained in detailed below with reference to several embodiments of the detergent of the invention and comparative example in which the effect of the constituents of the detergent has been investigated.

EXAMPLE 1

Embodiment of the Detergent of the Invention

| | |
|---|---|
| lipase (lipocatabolic enzyme) | 5 wt-% |
| sodium hydrogencarbonate (imbibing agent) | 90 wt-% |

-continued

| | |
|---|---|
| N-acylic amino acid (enzyme activation retaining agent) | 5 wt-% |

The above constituents are mixed well so as to prepare detergent of the invention. The lipase used is at a temperature of 20 degree Celsius and has a lipocatabolic ability of 10,000 u/g (the same lipase is used in Examples 2 to 4 given below). A suitable quantity of water is added to the detergent so as to provide an aqueous solution having a pit value between 7 to 9. The upper limit in pH value obtained by dissolving sodium hydrogencarbonate in water is 8.4. Thus, no conditioning agent is usually required when preparing this detergent. 1 gram of the detergent is used to wash tableware to which fatty material in the amount of 10 grams in lard-equivalent value (a typical amount of fatty material to be wasted by a family consisting of 5 members) has been adhered. As a result, the fatty material adhered to the tableware was sufficiently decomposed. An inclination for dirty material to be absorbed to the inner wall of a drain pipe is also restricted. The amount of N-acylic amino acid, which also serves as a surface active agent, has been reduced, while preservability of lipase and enzyme activation retaining ability of the same after dissolved are found to be improved.

EXAMPLE 2

Embodiment of the Detergent of the Invention

| | |
|---|---|
| lipase (lipocatabolic enzyme) | 5 wt-% |
| sodium hydrogencarbonate (imbibing agent) | 50 wt-% |
| N-acylic amino acid (enzyme activation retaining agent) | 5 wt-% |
| tartaric acid (foaming agent) | 15 wt-% |
| sodium hydrogen tartrate (foaming agent) | 20 wt-% |
| sodium carbonate (pH conditioning agent) | 5 wt-% |

The above constituents are mixed well so as to prepare detergent of the invention. A suitable quantity of water is added to the detergent so as to provide an aqueous solution having a pH value between 7 to 9.

1 gram of the detergent is used to wash tableware to which fatty material in the amount of 10 grams in lard-equivalent value has been adhered. As a result, the fatty material adhered to the tableware was sufficiently decomposed. Since this detergent contains a foaming agent, a vigorous amount of foam was generated during washing, whereby extremely high cleaning ability was obtained.

EXAMPLE 3

Embodiment of the Detergent of the Invention

| | |
|---|---|
| lipase (lipocatabolic enzyme) | 5 wt-% |
| sodium hydrogencarbonate (imbibing agent) | 70 wt-% |
| N-acylic amino acid (enzyme activation retaining agent | 25 wt-% |

The above constituents were mixed well so as to prepare detergent of the invention. An appropriate quantity of water is added to the detergent so as to provide aqueous solution containing the detergent of the invention. 1 gram of the above detergent is used to wash tableware to which fatty material in the amount of 10 grams (lard-equivalent value) has been adhered. As a result, such fatty material was sufficiently decomposed. Since relatively large amount of N-acylic amino acid is contained in the detergent, this detergent is capable of removing strongly adhered dirty material due to its surface acting ability. It was also found that activation of lipase has been maintained over extended period of time by the action of N-acylic amino acid.

EXAMPLE 4

Embodiment of the Detergent of the Invention

| | |
|---|---|
| lipase (lipocatabolic enzyme) | 5 wt-% |
| sodium hydrogencarbonate (imbibing agent) | 70 wt-% |
| N-acylic amino acid (enzyme activation retaining agent | 20 wt-% |
| prosthesis (protein decomposing agent) | 2.5 wt-% |
| amylase (hydrocarbon decomposing agent) | 2.5 wt-% |

The above constituents were mixed well to prepare detergent of the invention. An appropriate quantity of water was added to the detergent so as to provide aqueous solution of the detergent.

1 gram of the detergent was used to wash tableware to which fatty material in the amount of 10 grams (lard-equivalent value). As a result, such fatty material was sufficiently removed.

EXAMPLE 5

Embodiment of the Detergent of the Invention

| | |
|---|---|
| lipase (lipocatabolic enzyme) | 15,000 u |
| sodium hydrogencarbonate (imbibing agent) | 60 gr. |
| N-acylic amino acid (enzyme activation retaining agent) | 1 gr. |
| tartaric acid (foaming agent | 30 gr. |
| potassium hydrogen tartrate (foaming agent) | 30 gr. |
| sodium carbonate (pH conditioning agent) | 5 gr. |

The above constituents were mixed well. An appropriate quantity of water was added to the detergent so as to provide aqueous solution at pH value between 7 to 10 containing the detergent of the invention.

The aqueous solution of the detergent prepared in the above manner was introduced into a drain pipe (50 mm diameter) through an opening thereof. The drain pipe contained dirty material adhered to the wall thereof in the amount of 300 grams in dry weight and remaining water in the amount of 30 liters. The remaining water is intended a quantity of water which is not immediately discharged from the pipe, but tends to remain in the pipe. A solid fatty material, being main constituent of the slime adhered to the pipe was decomposed and imbibed by sodium hydrogencarbonate to form fine flocks or particulates, thus increasing its surface area. A quantity of remaining water after introducing the detergent of the invention is significantly reduced. Thus, the detergent of the invention is found to be extremely effective as a pipe cleaning agent.

EXAMPLE 6

Embodiment of the Detergent of the Invention

| | |
|---|---|
| lipase (lipocatabolic enzyme) | 60,000 u |
| sodium hydrogencarbonate (imbibing agent) | 60 gr. |
| N-acylic amino acid (enzyme activation retaining agent) | 5 gr. |
| tartaric acid (foaming agent | 10 gr. |
| potassium hydrogen tartrate (foaming agent) | 30 gr. |
| sodium carbonate (pH conditioning agent) | 5 gr. |

The above constituents were mixed well. An appropriate quantity of water was added to the detergent so as to provide aqueous solution having a pH value equal to and below which contains the detergent of the invention.

The aqueous solution of the detergent prepared in the above manner was introduced into a drain pipe (50 mm diameter) through an opening thereof. The drain pipe contained dirty material adhered to the wall thereof in the amount of 600 grams in dry weight and remaining water in the amount of 30 liters. Introduction of the aqueous solution containing the detergent was done, prior to insertion of wire into the pipe, simultaneously breaking the slime with the wire, or after breaking the slime. In any case, the slime was decomposed and removed in 5 to 10 minutes, without causing any blockage in the remaining portion of the pipe or in branch pipes which might be formed by such removed slime.

EXAMPLE 7

Embodiment of the Detergent of the Invention

| | |
|---|---|
| lipase (lipocatabolic enzyme) | 30,000 u |
| sodium hydrogencarbonate (imbibing agent) | 60 gr. |
| N-acylic amino acid (enzyme activation retaining agent) | 5 gr. |

The above constituents were mixed well. An appropriate quantity of water was added to the detergent so as to provide aqueous solution at a pH value equal to or less than 9 containing detergent of the invention.

The above aqueous solution was injected into a drain pipe (50 mm diameter) containing dirty material in the amount of 300 grams in dry weight. Injection of the aqueous solution was conducted by means of a wire braided hose having a nozzle at its tip end. The aqueous solution was injected at a rate of 20 liters per minute for 3 minutes (60 liters in total) and at a pressure of 80 kg per square centimeter. The aqueous solution containing the detergent was added to a 60-liter water at one time or gradually. Injection pressure from the nozzle was sufficient to break the slime adhered to the wall of the pipe.

Figure 2:
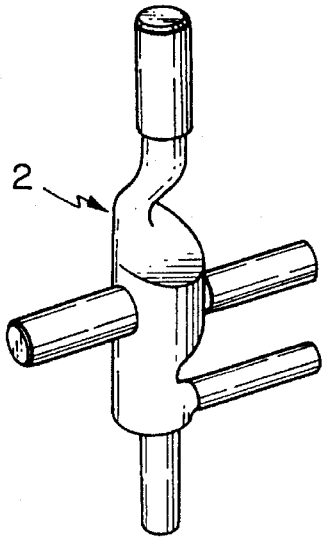
FIG. 2 is a cross-sectional view of a ventilation fitting.
Figure 3:
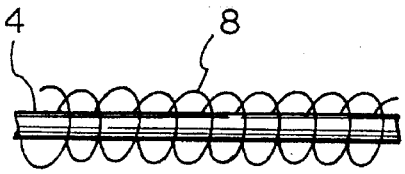
FIG. 3 is a perspective view, in part, of a hose intended to be inserted into a bent pipe.

Cleaning of a piping may be carried out using, for example, a device shown in FIG. 1. FIG. 1 is an illustrative view showing a cleaning method for a piping in a high-rise building. In the drawing, reference numeral 3 designates a pump for supplying water under high pressure, 4 a hose connected to a discharge port of the pump, and 5 an injection nozzle attached to the tip of the hose. The nozzle has a injection mouth which will be rotated by means of a propulsion force of a liquid during injection. Reference numeral 6 designates a supply of detergent of the invention. The detergent supply is designed to supply an appropriate amount of detergent to a quantity of water pressurized by the pump 3. Thus, high pressure water ejected from the nozzle 5 contains a predetermined amount of detergent mixed therewith and dissolved therein. When it is intended to wash or clean a piping including a plurality of bends such as elbows or tees, or bent pipe such as ventilation fitting (TM) shown in FIG. 2, a length of hose 4 braided with guide wire 8 is inserted into such piping or pipe. Even in this case, relatively low pressure as mentioned above is sufficiently used so as to conduct cleaning work, without giving any damage to pipe fittings. In a complicated piping in particular, the detergent solution, when ejected, is splashed inside the piping in a mist or fog manner so as to adhere substantially the whole inner surface of the piping. Thus, inner wall of a piping which has been difficult to be cleaned in prior art technique may be securely cleaned.

When the above device is used to wash drain piping in a high-rise building as shown in FIG. 1, the hose 4 and the nozzle 5 are inserted into the vertical drain piping 1 to a predetermined level or depth (lowermost part where the drain piping is connected with a drainage ditch). Then, the pump 3 is operated. Thereafter, the nozzle 5 is retracted or raised to the port through which the nozzle has been inserted, while ejecting detergent solution from the nozzle. When the vertical piping 1 has been washed, the hose 4 and nozzle 5 are inserted into the horizontal pipings 2 through their respective distal openings **2*b* until the nozzle 5 reaches the vertical piping 1. Then, the horizontal piping 2 may be washed in the same manner. It is noted that, though the nozzle 5 is displaced or moved in the horizontal piping 2** along the bottom wall thereof, the inner wall of the horizontal piping may be uniformly washed or cleaned by means of the decomposing ability of lipocatabolic lipase, since the detergent solution is splashed in the piping in a mist or fog manner so as to adhere to substantially the whole inner surface of the piping including the upper surface thereof.

Figure 4:
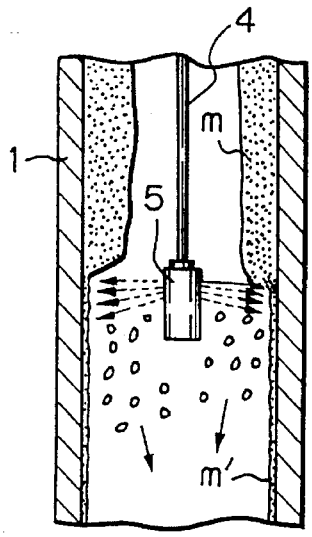
FIG. 4 is an illustrative view showing injection of detergent solution of the invention ejected from a nozzle for the purpose of washing inner wall of a drain pipe.

FIG. 4 illustrate operation to be occurred within a pipe during injection of an aqueous solution. Deposition of slime (m) protruding From the wall of the pipe toward the central portion of the pipe was broken into pieces by means of impact energy of the aqueous solution containing the detergent. Then, the slime broken into pieces was brought in every direction by means of a flow of the aqueous solution containing the detergent, which has hit against the wall of the pipe to be splashed, so as to be simultaneously mixed therewith. Thus, the small pieces of slime were covered with aqueous solution containing the detergent on substantially whole surface thereof, so that solid fatty material was decomposed by lipocatabolic lipase and removed from the pipe. When the deposit of slime protruding toward the central region of the pipe has been removed, a slime layer (m') adhered to the wall was covered with aqueous solution containing the detergent, so that the slime layer was decomposed and removed from the wall. As a result, the inner wall of the pipe was uniformly cleaned.

It was found in this Example that injection pressure from a nozzle is enough if it is able to break the deposit of slime to be mixed with the aqueous solution of the detergent, but is not unnecessary to be sufficiently high to remove or strip the slime layer or slime coating. The aqueous solution containing the detergent is ejected at a high pressure, so that the aqueous solution is splashed on substantially the whole surface of the pipe to be cleaned. It is found therefore that, even though the injection nozzle is offset from the center line of the pipe, slime may be removed entirely, so that the wall of the pipe is cleaned uniformly.

Comparative Example

Discussion on Dispersion Effect against Solid Fatty Material

In this Example, dispersion effect of a solution containing water and sodium hydrogencarbonate was investigated.

An aqueous solution containing sodium hydrogencarbonate at a pH value of 8.1 was prepared by dissolving 7.5 gr. of sodium hydrogencarbonate in 50 cc of water. 50 cc of water was separately prepared. The water and aqueous solution were both maintained at a temperature of 25 degree Celsius. Solid lard of 5 gr was put into the water and the aqueous solution so as to investigate the difference therebetween. After 60 minutes, no change was observed with respect to the lard contained in the water. Contrariwise, the lard contained in the sodium hydrogencarbonate solution, after 10 minutes, was dispersed therein to form small pieces, thus increasing its surface area.

Comparative Example

Investigation on Synergistic Effect of Lipase and Sodium Hydrogencarbonate

In this Example, decomposing effect or lipocatabolic ability of lipase was investigated with respect to the case in which lipase is used under the presence of sodium hydrogencarbonate and the case in which it is used without sodium hydrogencarbonate.

50 cc of water was prepared and 50 cc of aqueous solution of sodium hydrogencarbonate at a pH value of 8.0 was also prepared. The aqueous solution was prepared by dissolving 0.5 gr. of sodium hydrogencarbonate in 50 cc of water. The water and aqueous solution were both maintained at a temperature of 25 degree Celsius. A quantity of lipocatabolic lipase and solid lard of 5 gr were added to both the water and aqueous solution. The lipase used is such as to be activated at pH 7. The lard in each of the water and the aqueous solution was observed after 10 minutes. As a result, substantially the same dispersed state was observed with respect to the lard contained in the water added with 0.01 gr. of lipase and the lard contained in the aqueous solution of sodium hydrogencarbonate added with 0.01 gr. of lipase. This means that sodium hydrogencarbon solution only requires one-tenth of lipase required by a solution containing no sodium hydrogencarbonate in order to achieve the same lipocatabolic effect.

Daily use of the detergent of the invention permits fatty material adhered to tableware or the like to be decomposed and dissolved in water due to the lipocatabolic effect of lipase. The detergent having washed away from the tableware, together with water, is flown into a drain pipe. Thus small amount of lipase and sodium hydrogencarbonate are absorbed by the wall of the drain pipe and retained there. This prevents fatty material from adhering to the wall of the drain pipe. Such adhesion of fatty material may cause solidification of fatty material which leads to blockage of a piping.

When the detergent of the invention is used to a drain piping, solid, fatty material contained in slime is imbibed and dispersed in flock or granular state by means of a imbibing agent, so that fatty material may be efficiently decomposed by means of lipase.

When the detergent of the invention is used under the presence of foaming agent, the forming agent is reacted with water and basic, sodium hydrogencarbonate to form vigorous amount of foam. This facilitates fatty material to be imbibed so as to increase surface area thereof on which lipase may effectively act, thus increasing lipocatabolic ability of lipase. Thus, solid, fatty material, to which the detergent of the invention is not directly adhered, may be decomposed and removed.

The present invention may also provide harmless detergent, by adjusting pH value thereof to a weak basic region, i.e., pH 7 to 10, which can be handled safety and which does not cause ecological problem such as water pollution. The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the spirit of the present invention. Accordingly, the foregoing detailed description should be exemplary in nature and not as limiting to the scope and spirit of the invention set forth the appended claims.

What is claimed is:

1. A method of cleaning drain pipes or tableware comprising:

forming a composition containing (a) more than 1%, based on the weight of the detergent composition, of a lipase which has a lipocatabolic ability of 10–100μ;

(b) an N-acylic amino acid; and (c) an imbibing agent in an effective amount wherein the imbibing agent is selected from the group consisting of sodium hydrogen carbonate, magnesium carbonate, calcium carbonate, ammonium hydrogen carbonate, ammonium carbonate and mixtures thereof, and thereafter delivering the composition under pressure to the surface of the drain or tableware to be cleaned.

2. The method of claim 1 wherein said lipase has a lipocatabolic ability of 20–60μ.

3. The method of claim 1 wherein the composition contains more than 50% by weight sodium hydrogen carbonate.

4. The method of claim 1 wherein the composition is dispersed as an aqueous solution prior to application to the drain or tableware.

5. The method of claim 4 in which the composition further comprises a foaming agent and a pH conditioning agent.

6. The method of claim 4 in which the aqueous solution has a pH of from 7–10.

7. The method of claim 5 wherein the foaming agent is selected from the group consisting tartaric acid, potassium hydrogen tartrate, citric acid, succinic acid, malic acid, uric acid, fumaric acid, sodium fumaric acid and mixtures thereof.

8. The method of claim 5 in which the pH conditioning agent is selected from the group consisting of sodium carbonate, sodium silicate, sodium sulfate, and mixtures thereof.

9. The method of claim 6 in which pH is from 7–9.

10. The method of claim 1 wherein the composition is introduced to the drain pipe at a rate of 20 liters per minute and at a pressure of at least 80 kg per square centimeter.

* * * * *